US008907571B2

(12) United States Patent
Yang

(10) Patent No.: US 8,907,571 B2
(45) Date of Patent: Dec. 9, 2014

(54) LAMP DRIVING CIRCUIT OF POWER SOURCE AND CHARGE/DISCHARGE DEVICE IN PARALLEL CONNECTION

(76) Inventor: Tai-Her Yang, Dzan-Hwa (TW)

( * ) Notice: Subject to any disclaimer, the term of this patent is extended or adjusted under 35 U.S.C. 154(b) by 1220 days.

(21) Appl. No.: 12/320,379

(22) Filed: Jan. 26, 2009

(65) Prior Publication Data

US 2009/0195165 A1 Aug. 6, 2009

Related U.S. Application Data

(60) Provisional application No. 61/006,833, filed on Feb. 1, 2008.

(51) Int. Cl.
*H05B 33/08* (2006.01)

(52) U.S. Cl.
CPC ..... *H05B 33/0827* (2013.01)
USPC ..... 315/152; 315/149; 315/160

(58) Field of Classification Search
CPC .. H05B 37/0272; H05B 37/034; H05B 37/03; H05B 37/02; H05B 41/2983; H05B 33/0842; H05B 33/0848; H05B 33/0827
USPC ..... 315/149, 152, 155, 158, 159, 160; 323/906; 320/102, 138
See application file for complete search history.

(56) References Cited

U.S. PATENT DOCUMENTS

| | | | | |
|---|---|---|---|---|
| 4,200,904 | A * | 4/1980 | Doan | 362/183 |
| 5,839,816 | A * | 11/1998 | Varga et al. | 362/183 |
| 5,880,946 | A * | 3/1999 | Biegel | 363/75 |
| 6,081,101 | A * | 6/2000 | Yang | 320/154 |
| 6,131,321 | A * | 10/2000 | Daigle, Jr. | 315/159 |
| 6,294,983 | B1 * | 9/2001 | Lee | 340/332 |
| 6,784,357 | B1 * | 8/2004 | Wang | 362/183 |
| 7,685,753 | B2 * | 3/2010 | Slowski | 40/550 |
| 7,828,463 | B1 * | 11/2010 | Willis | 362/276 |
| 2006/0123679 | A1 * | 6/2006 | Scruggs | 40/559 |

FOREIGN PATENT DOCUMENTS

WO WO 01/33311 * 4/2002

* cited by examiner

*Primary Examiner* — Jimmy Vu
*Assistant Examiner* — Amy Yang
(74) *Attorney, Agent, or Firm* — Bacon & Thomas, PLLC

(57) ABSTRACT

An application for nightly outdoor lamps, road lamps, advertising lamps and nightly warning lights using daytime and nighttime as the period, wherein during daytime, it is at a preparation status of no power output to drive the lamps, and the AC to DC power is charged to the charge/discharge device, while during nighttime, the lamps are commonly driven by the parallel output of an AC to DC power and the discharged power from the charge/discharge device.

25 Claims, 12 Drawing Sheets

LAMP DRIVING CIRCUIT OF POWER SOURCE AND CHARGE/DISCHARGE DEVICE IN PARALLEL CONNECTION

BACKGROUND OF THE INVENTION (a) Field of the invention

The lamp driving circuit of power source and charge/discharge device in parallel connection is disclosed by that: 1) At the preparation status of no power output to drive the lamp, the charge/discharge device is charged by an AC to DC power to maintain a good electricity storing status; 2) At parallel output status of power output to drive the lamp, the power output of charge/discharge device and AC to DC power jointly drive the lamp. Said preparation status of no power output to drive the lamp and said lamp being driven by the parallel output appear a stable periodical variation such as applications for nightly outdoor lamps, road lamps, advertising lamps, nightly warning lights, etc. are based on periods of days and nights, wherein during daytime it is at the preparation status of lamps off, the charge/discharge device is charged by the AC to DC power and during nighttime, the lamps are commonly driven by a parallel combined power output of the AC to DC power and the charge power from the charge/discharge device; further, an auxiliary type random power generator device can be optionally installed as needed such as a solar energy generation device or a wind power or hydraulic power generator device to randomly charge the charge/discharge device.

(b) Description of the Prior Art

The charge/discharge device such as batteries, super-capacitors, etc. are usually used as a reserved power source to power the lamps, however, when the lamps are required to be driven by a larger periodic or intermittent power, if the capacity of the charge/discharge device is enlarged so as to power the lamp by the charge/discharge device alone, the cost is higher and said charge/discharge device is required to work at a larger electric current which affects the battery life, in addition, a charge/discharge device of larger power capacity have to be used simultaneously in order to match with the charge/discharge device of larger capacity, resulting in a waste of resources and cost increase;

Furthermore, if the lamps are parallel connected for powering by extension cords of the circuit, the lamp lightness is disadvantageously affected due to voltage drop at terminal end of extension cord.

SUMMARY OF THE INVENTION

The lamp driving circuit of power source and charge/discharge device in parallel connection is disclosed to appear a preparation status and a parallel output status which are operated and controlled manually or by an environment light and darkness detector device or a timing device, or by a built-in control mode of the central control unit with reference to detected signals by a charging status detector circuit, or reference to the control or detected signals by said light and darkness detector device or timing device, wherein the circuit includes that at preparation status of lamps off, the AC to DC power is charged to the charge/discharge device, and at parallel output status, the AC to DC power and discharged power from charge/discharge device are combined to commonly drive the lamps. As discharged power of charge/discharge device and AC to DC power are parallel connected to drive the lamps, a smaller installed capacity of said charge/discharge device can be selected and the power capacity of transformer device and circuit devices for AC to DC rectification can also be relatively reduced, further when electricity generation of the optionally installed auxiliary type random power generator devices of solar power generator devices, wind power or hydraulic power generator devices, etc. is insufficient to charge the charge/discharge device completely, the charge/discharge device can also be charged by AC power.

DESCRIPTION OF MAIN COMPONENT SYMBOLS

BC100: Charging control device
BCD100: Charging status measure device
BR100: Rectifier device
CCU100: Central control unit
CD100: Lamp control device
CD101: power source side control device
CD102: output side control device
CR100: Output diode
CR101, CR102: Diode
ESD 100: charge/discharge device
IP100: Over current protective device
L100: Lamps
RPC100: Random power generator device controller
RPS100: Random power generator device
S100: Environment light and darkness detector device
TR101: Transformer device
U100, U200: Lamp unit
U300: Lamp assembly

DETAILED DESCRIPTION OF THE PREFERRED EMBODIMENTS

Figure 1:
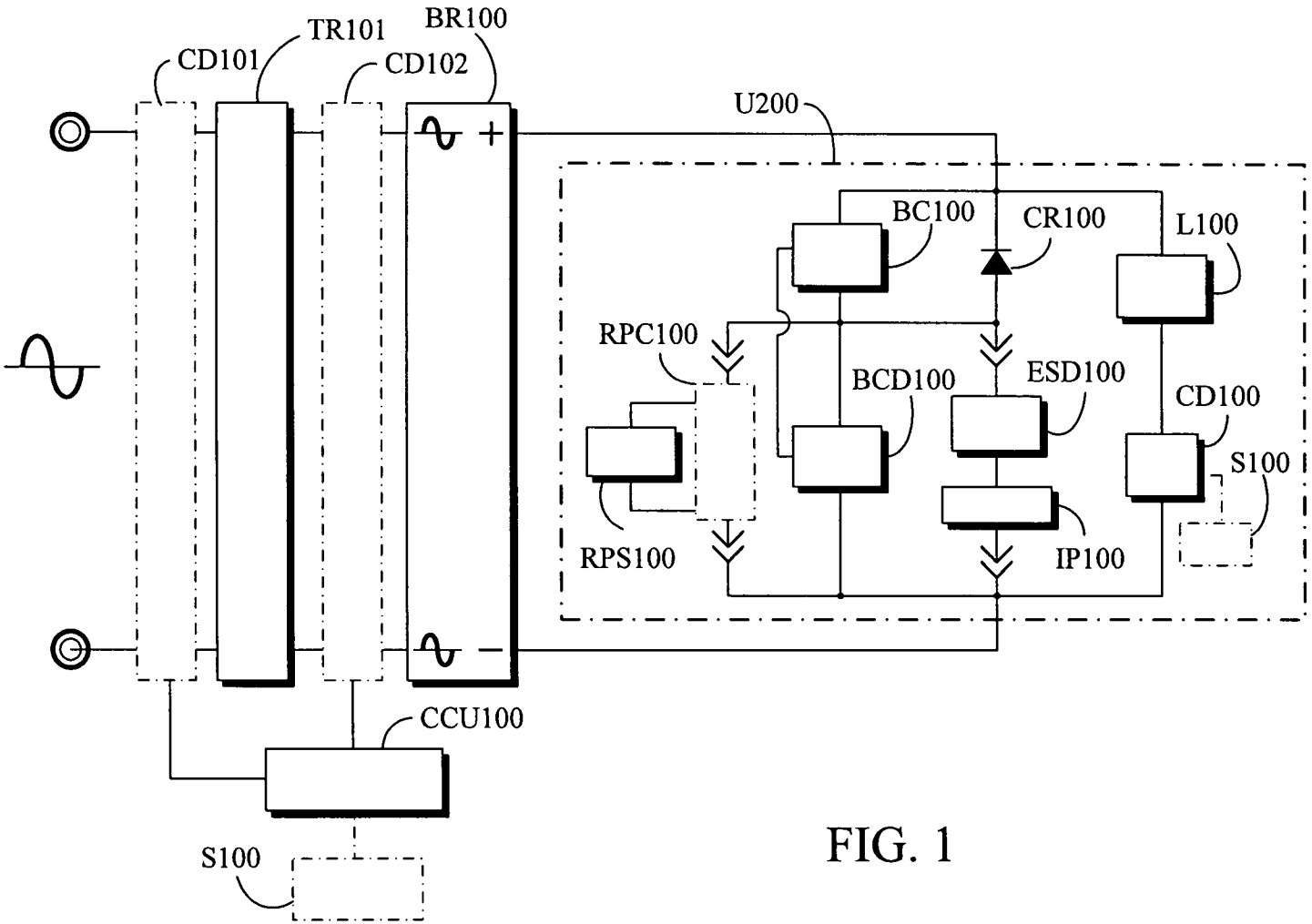
FIG. 1 is a system block view of the invention

FIG. 1 is a system block diagram of the lamp driving circuit of power source and charge/discharge device in parallel connection which mainly comprises the following units:

A transformer device TR101: it is constituted by electromechanical type or electronic type transformers for AC power output of voltage drop or voltage rise;

The AC power source is provided by utility AC power supply or AC power generated by an AC power generator, or AC power converted from DC power source;

A power source side control device CD101: It is constituted by electromechanical or solid state electronic components having a switching or voltage controllable function or attaching with a controller device for electric current control. It is installed between AC power source and input sides of transformer device TR101 to be operated and controlled by the central control unit CCU100 or by the environment light and darkness detector device S100, wherein said power source side control device CD101 can be selectively installed or not installed as needed;

An output side control device CD 102: It is constituted by electromechanical or solid state electronic components having a switching or voltage controllable function or attaching with a controller device for electric current control. It is installed between output sides of the transformer device TR101 and input sides of the rectifier device BR100 to be operated and controlled by the central control unit CCU100 or by the environment light and darkness detector device S100, wherein said output side control device CD102 can be optionally installed or not installed as needed;

A rectifier device BR100: It is constituted by a full wave rectifier device or a half-wave rectifier device to rectify AC power output of the secondary side of transformer device TR101 into a DC power output as the driving power source for lamp L100 and as the charging power source for charge/discharge device ESD100;

A charge/discharge device ESD100: It is a secondary battery for repeatedly charge/discharge use and is constituted by nickel series batteries such as lead-acid, nickle-cadium, nickle-hydrogen, or nickle-zinc batteries, or lithium series batteries such as lithium ion etc. or is constituted by other secondary batteries or super-capacitors, etc., wherein its negative output ends are connected to the negative DC power output ends of the rectifier device BR100, while the positive output ends of said charge/discharge device ESD100 are connected to a charge control device BC100 for charge power supply. The positive output ends of said charge/discharge device ESD100 simultaneously supply power to drive lamp L100 through an output diode CR100, wherein said charge/discharge device can be fixedly installed in the circuit or installed with a plug, a socket set, or a connector for assembly or for replacement;

A charging status measure device BCD100: It is a measuring circuit device by taking end voltage or measurements of internal resistance, specific gravity, charging capacity or discharging capacity, etc. of the charge/discharge device ESD100 as parameters for continuous or periodic detection and conversion into digital or analog electric energy signals, and includes an analog measuring circuit comprising electromechanical or solid state components or a digital measuring circuit comprising microprocessors, relevant softwares, and interface electronic components for installation between the two ends of positive and negative power sources of said charge/discharge device ESD100, wherein said device can be optionally installed or not installed as needed;

A charge control device BC100: It is constituted by electromechanical or solid state components for connecting with a rectifier device BR100 to control the charging voltage and current value of the AC to DC charging/discharge device ESD100, or to be passively controlled by the central control unit CCU100 to control the charging voltage and current value of the AC to DC charge/discharge device ESD100, wherein said device can be optionally installed or not installed as needed;

An output diode CR100: It is a diode with an unidirectional electricity transmission function for parallel connecting across the two ends of charge control device BC100 at opposite polarity to transmit the power of charge/discharge device ESD100 to the lamp L100;

An over current protective device IP100: It is an over current protective device which is series connected between the input and output ends of charge/discharge device ESD100 comprising a resistive or inductive impedance component, an impedance component of said two in combination, a semi-conductor component of voltage drop, a safety fuse, or an overload breaker, etc., wherein said device can be optionally installed or not installed as needed;

An environment light and darkness detector device S100: It is constituted by an electronic component or device capable of producing varied impedances, varied voltage outputs, varied multifications, or other physical reactions relative to environment lights to receive the operation and control by a central control unit CCU100, a lamp control device CD100, a power source side control device CD101 or an output side control device CD102, wherein said device can be optionally installed or not installed as needed;

A central control unit CCU100: It is constituted by electromechanical or solid state electronic components, or by a microprocessor with relevant softwares having functions of setting power on/off timing or built-in power on/off mode for lamps L100, or receiving signals from the environment light and darkness detector device S100 to operate and control the power on/off or passing voltage or current values of the power source side control device CD101, the output side control device CD102, or the lamp control device CD100, wherein said central control unit CCU100 can be optionally installed or not installed as needed;

A lamp control device CD100: It is constituted by electromechanical or solid state electronic components to receive the operation and control by the central control unit CCU100 or the environment light and darkness detector device S100 to produce an on/off function for the lamps L100 power on/off, or for modulating voltage or current to the lamps L100, wherein said device can be optionally installed or not installed as needed;

The lamps L100: They are constituted by various conventional DC power driven lamps and are driven to emit lights by receiving DC power output from the rectifier device BR100, or by receiving DC power output from the charge/discharge device ESD100, or by receiving DC power output from the rectifier device BR100 and DC power from the charge/discharge device ESD100 simultaneously, wherein said lamps L100 and power source can be optionally series connected with a lamps control device CD100 as needed to receive the operation and control by a central control unit CCU100 or a environment light and darkness detector device S100 to produce an on/off function for lamps L100 power on/off, or for modulating voltage or current to lamps L100;

A random power generator device RPS100: It is constituted by a solar power generator device, a wind power generator device or a hydraulic power generator device for random power generation to generate power through a random power generator device controller RPC100 which is parallel connected across the DC output ends of a rectified device BR100 for charging said charge/discharge device ESD100 through a charge control device BC100 or supply power to the lamps L100, wherein said device can be optionally installed or not installed as needed;

A random power generator device controller RPC100: It is constituted by electromechanical or solid state electronic components to install across the DC output ends of the random power generator device RPS100 and the rectifier device BR100 for controlling the generation voltage value and current value of said random power generator device RPS100 to the negative and positive output ends of said rectifier device BR100, wherein said device can be optionally installed or not installed as needed;

Each component of said lamp driving circuit of power source and charge/discharge device in parallel connection can be independently installed or integrally combined by relevant components, wherein relevant components which are more commonly integrally installed are listed as examples in the following:

1. The power source side control device CD101, transformer device TR101, output side control device CD102, rectifier device BR100 and central control unit CCU100 are integrally combined; or 2. The random power generator device controller RPC100 and the random power generator device RPS100 are integrally combined; or 3. The charge/discharge device ESD100, over current protective device IP100, charging status measure device BCD100, charge control device BC100, and output diode CR100 are integrally combined; or 4. The lamp control device CD100, lamp L100 and environment light and darkness detector device S100 are integrally combined to constitute a lamp unit U100; or 5. The random power generator device controller RPC100, random power generator device RPS100, charge/discharge device ESD100, over current protective device IP100, charging status measure device BCD100, charge control device BC100, and output diode CR100 are integrally combined to constitute a lamp unit U200; or 6. The charge/discharge device ESD100, over current protective device IP100, charging status measure device BCD100, charge control device BC100, output diode CR100, lamp control device CD100, lamp L100, and environment light and darkness detector device S100 are integrally combined to constitute a lamp unit U200; or 7. The charge/discharge device ESD100, over current protective device IP100, charging status measure device BCD100, charge control device BC100, output diode CR100, lamp control device CD100, lamp L100, environment light and darkness detector device S100, random power generator device controller RPC100 and random power generator device RPS100 are integrally combined to constitute a lamp assembly U300.

Figure 2:
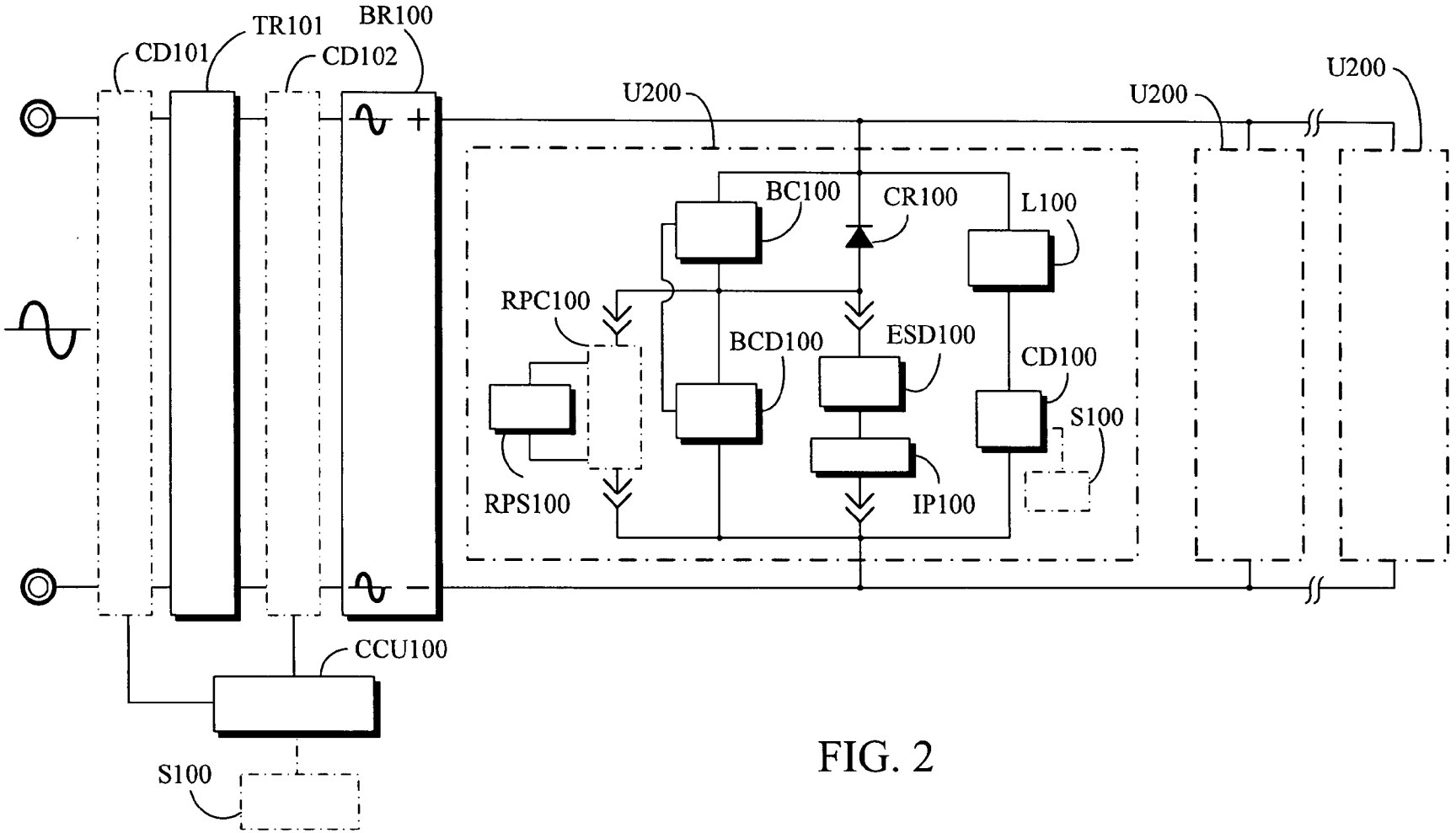
FIG. 2 is a system circuit block view of the invention showing that multiple lamp assemblies are powered by an AC to DC power source.

Said lamp driving circuit of power source and charge/discharge device in parallel connection as shown in FIG. 2 includes that multiple sets of the lamp assemblies U300 are powered by an AC to DC power source. Referring to FIG. 2, at least the charge/discharge device ESD100, over current protective device IP100, charging status measure device BCD100, charge control device BC100, output diode CR100, lamp control device CD100, lamp L100, environment light and darkness detector device S100, random power generator device controller RPC100, and random power generator device RPS100 are optionally integrally combined to constitute a lamp assembly U300 for parallel connection across the output ends of said rectifier device BR100 or for parallel installation of each lamp assembly U300 by extension cords;

FIG. 2 is a system circuit block diagram of the invention showing that multiple sets of lamp assemblies U300 are powered by an AC to DC power source.

FIG. 2 mainly comprises of the following:

The power source side control device CD 101, transformer device TR101, output side control device CD102, rectifier device BR100, and central control unit CCU100 constitute an AC to DC power source, wherein the environment light and darkness detector device S100 for controlling the power source side control device CD101, the output side control device CD102, or the central control unit CCU100 can be optionally installed or not installed as needed;

At least two lamp assemblies U300 with each constituted by the charge/discharge device ESD100, over current protective device IP100, charging status measure device BCD100, charge control device BC100, output diode CR100, lamp control device CD100, lamp L100, environment light and darkness detector device S100, random power generator device controller RPC100, and random power generator device RPS100, etc. are parallel connected across the DC output ends of AC to DC rectifier device BR100 or are parallel connected with extension cords of DC output ends of rectifier device BR100;

An environment light and darkness detector device S100 can be optionally selected to be:

1. The environment light and darkness detector device S100 is installed to control the power source side control device CD101, or the output side control device CD102 which controls the transformer device TR101; or to control the central control unit CCU100 which further controls the power source side control device CD101 or the output side control device CD102; or 2. The environment light and darkness detector device S100 is individually attached to the lamp control device CD100 of lamp L100 in each lamp assembly U300 to control the lamp control device CD100 of lamp L100 in each lamp assembly U300 individually, thereby to control its corresponding lamp L100; or 3. The environment light and darkness detector device S100 is installed in both said cases of 1, 2.

Each component of said lamp driving circuit of power source and charge/discharge device in parallel connection as described above can be independently installed or integrally combined by relevant components.

Figure 3:
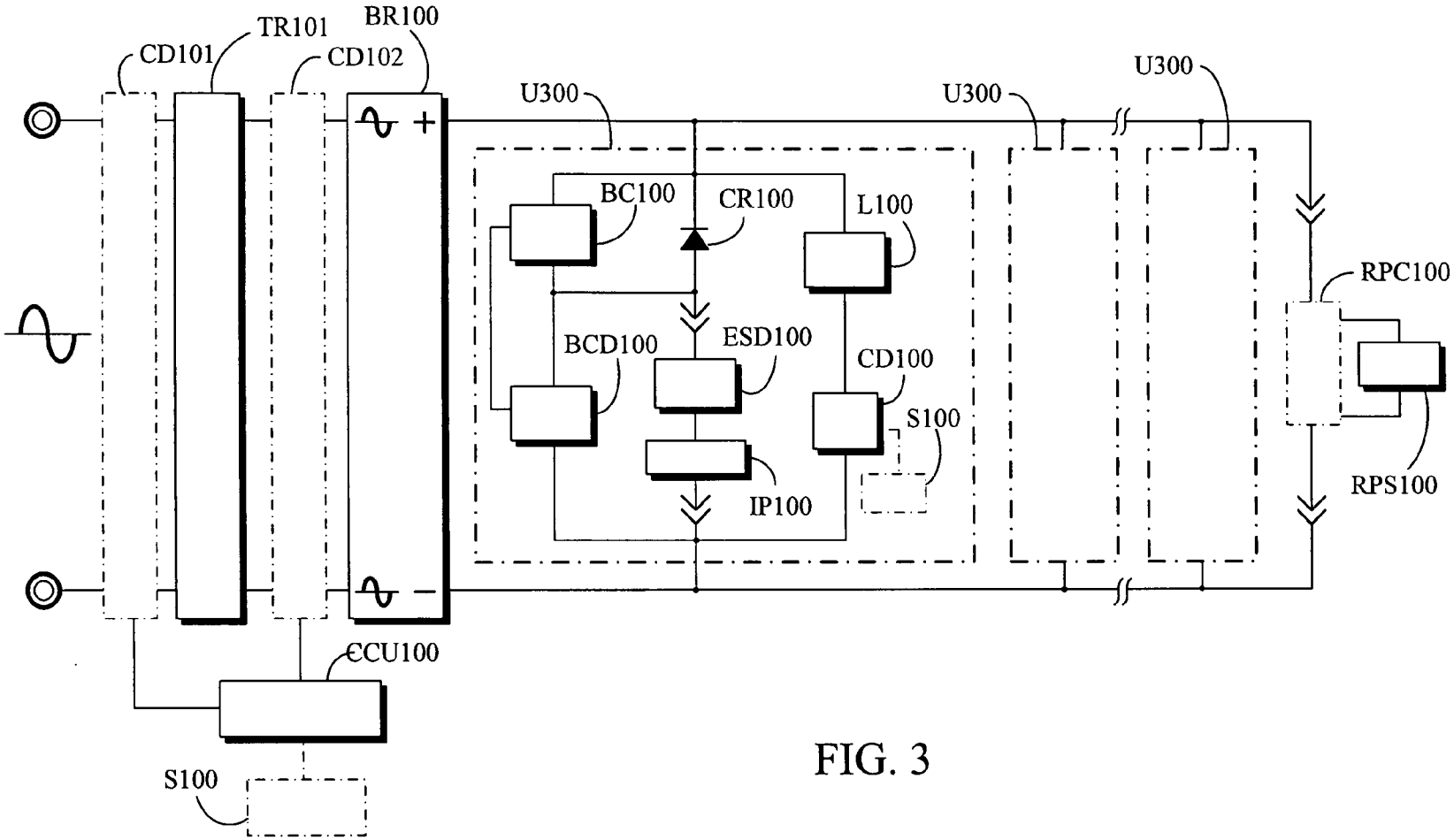
FIG. 3 is a circuit block view showing that the random power generator device and the random power generator device controller are parallel connected with extension cords to power each lamp unit in parallel connection.

Said lamp driving circuit of power source and charge/discharge device in parallel connection as shown in FIG. 3 includes that the random power generator device and the random power generator device controller are parallel connected to extension cords to power each lamp unit U200 in parallel connection, Referring to FIG. 3, wherein each lamp L100 being individually series connected with the lamp control device CD100 and being individually installed with an environment light and darkness detector device S100 for controlling the individual lamp control device CD100, and being attached a charge/discharge device ESD100, a over current protective device IP 100, a charging status measure device BCD100, a charge control device BC100, and an output diode CR100 to constitute a lamp unit U200, whereby one or more than one sets of the lamp units U200 are parallel connected to extension cords, the power source ends whereof are parallel connected with the AC to DC output ends constituted by the power source side control device CD 101, transformer device TR101, output side control device CD102 and rectifier device BR100, in addition, the random power generator device RPS100 and the random power generator device controller RPC100 are also installed on extension cords while output ends of the random power generator device controllers RPC10 of same polarities are parallel connected across extension cords.

Said environment light and darkness detector device S100 of said lamp driving circuit of power source and charge/discharge device in parallel connection can be optionally installed as needed to control the power source side control device CD101, or to control the output side control device CD102 of the transformer device TR101, or to control central control unit CCU100 which controls the power source side control device CD101 or the output side control device CD102, or said environment light and darkness detector device S100 can be optionally selected not to be installed.

Each component of said lamp driving circuit of power source and charge/discharge device in parallel connection as described above can be independently installed or integrally combined by relevant components.

Figure 4:
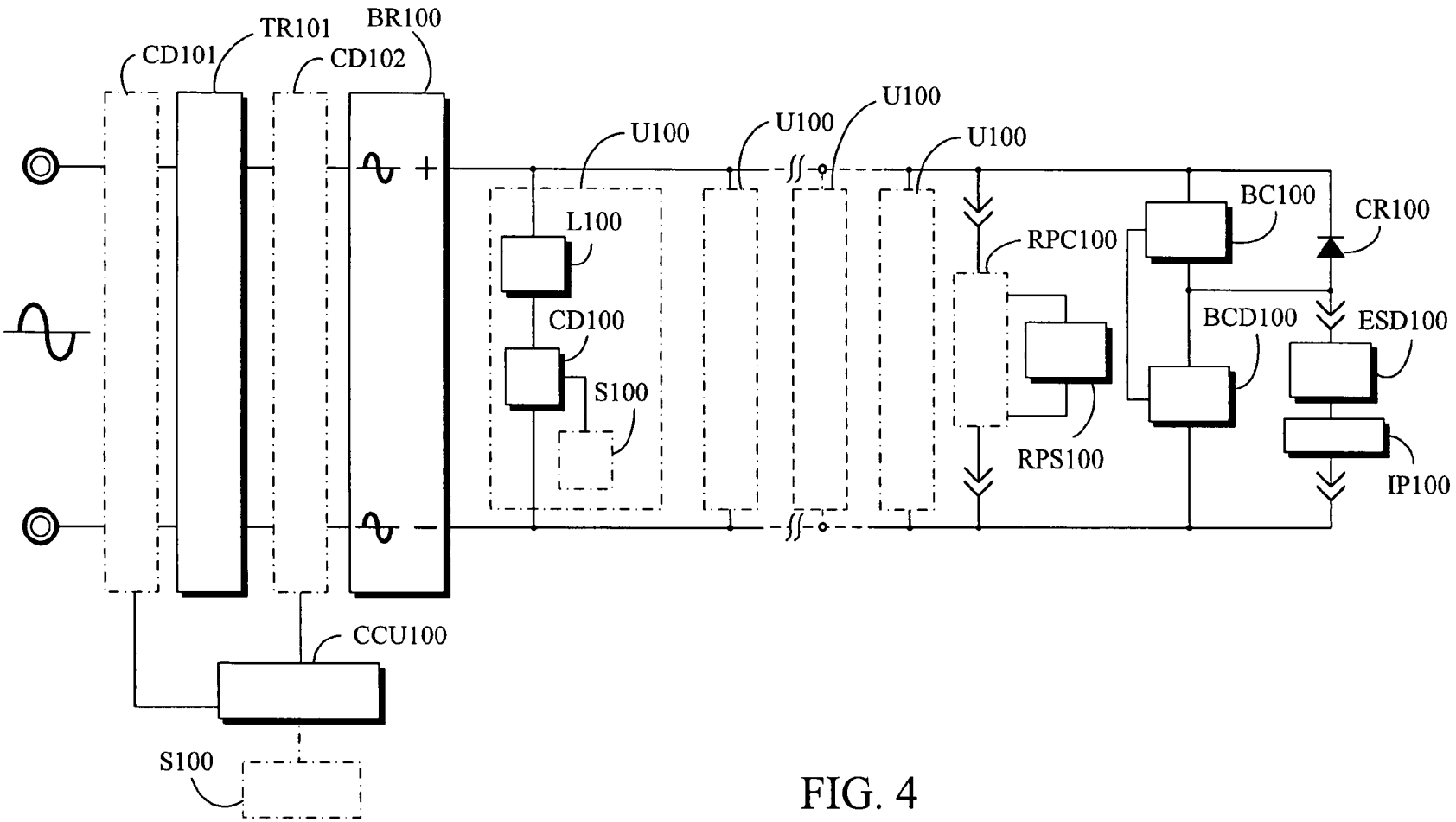
FIG. 4 is a circuit block view showing that the charge/discharge device is parallel connected with terminal ends of extension cords to power each lamp unit in parallel connection

Said lamp driving circuit of power source and charge/discharge device in parallel connection as shown in FIG. 4 can be that the charge/discharge device is parallel connected to terminal ends of extension cords to power each lamp unit U100 in parallel connection. Referring to FIG. 4, each lamp L100 being individually series connected with a lamp control device CD100 which is controlled individually by an environment light and darkness detector device S100 constitutes a lamp unit U100, wherein one or more than one sets of the lamp unit U100 is parallel connected to extension cords, the power source ends whereof are parallel connected with the output ends of AC to DC power source constituted by the power source side control device CD101, the transformer device TR101, the output side control device CD102 and the rectifier device BR100, while terminal ends of said extension cords are especially parallel connected with a charge/discharge device ESD100, an over current protective device IP100, a charging status measure device BCD100, a charge control device BC100, and an output diode CR100 to improve the voltage drop thereof.

Said environment light and darkness detector device S100 of said lamp driving circuit of power source and charge/discharge device in parallel connection can be optionally installed as needed to control the power source side control device CD101, or to control the output side control device CD 102 of the transformer device TR101, or to control the central control unit CCU100 which controls the power source side control device CD101 or the output side control device CD102, or said environment light and darkness detector device S100 can be optionally selected not to be installed.

Further, the random power generator device controller RPC100 and the random power generator device RPS100 can be optionally installed as needed, while output ends of random power generator device controllers RPC100 of same polarities are parallel connected to extension cords.

Each component of said lamp driving circuit of power source and charge/discharge device in parallel connection as described above can be independently installed or integrally combined by relevant components.

FIG. 4 is a circuit block diagram showing that the charge/discharge device is parallel connected with terminal ends of extension cords to power each lamp unit U100 in parallel connection.

Referring to FIGS. 1~4, the positive output end of the random power generator device controller RPC100 in the random power generator device RPS100 is connected with the input end of charge control device BC100 which receives positive power from the rectifier device BR100, while the negative output end of the random power generator device controller RPC100 is connected with the negative output end of the rectifier device BR100, so that the output power of the random power generator device RPS100 is modulated through the random power generator device controller RPC100 and the charge control device BC100 to charge the charge/discharge device ESD100; wherein methods of said parallel connections includes one or more than one methods as following:

1. The positive output end of the random power generator device controller RPC100 is connected with the input end of the charge control device BC100 which receives positive power from the rectifier device BR100, while the negative output end of the random power generator device controller RPC100 is connected with the negative output end of the rectifier device BR100;

2. The positive output end of the random power generator device controller RPC100 is forward series connected with a diode CR101 and further connected with the input end of the charge control device BC100 which receives positive power from the rectifier device BR100, while the negative output end of the random power generator device controller RPC100 is connected with the negative output end of the rectifier device BR100;

3. The positive output end of the random power generator device controller RPC100 is forward series connected with a diode CR101 and further connected with the input end of the charge control device BC100 which receives positive power supplied by the rectifier device BR100 through a diode CR102 in forward series connection, while the negative output end of the random power generator device controller RPC100 is connected with the negative output end of the rectifier device BR100;

4. The positive output end of the random power generator device controller RPC100 is connected to the input end of the charge control device BC100 which receives positive power supplied by the rectifier device BR100 through a diode CR102 in forward series connection, while the negative output end of the random power generator device controller RPC100 is connected to the negative output end of the rectifier device BR100.

Each component of said lamp driving circuit of power source and charge/discharge device in parallel connection as described above can be independently installed or integrally combined by relevant components.

Figure 5:
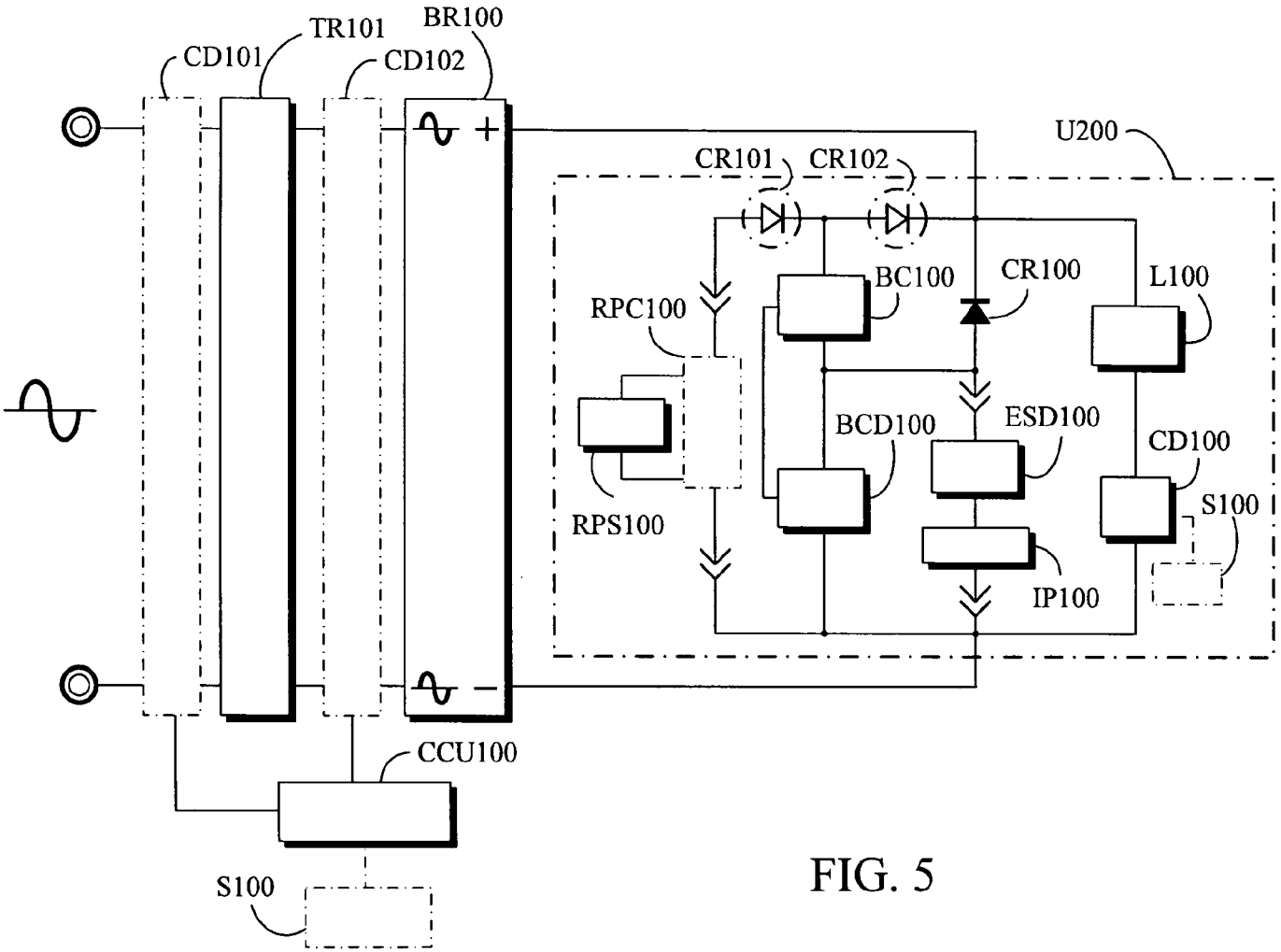
FIG. 5 is a circuit schematic view of the embodiment in FIG. 1 showing that positive and negative output ends of the random power generator device controller are parallel connected to the positive input end of the charge control device and the negative output end of the rectifier device.

FIG. 5 is a circuit schematic view of the embodiment in FIG. 1 showing that positive and negative output ends of the random power generator device controller RPC100 are parallel connected to the positive input end of the charge control device BC100 and the negative output end of the rectifier device BR100.

The methods for connecting the output end of the random power generator device controller RPC100 and the charge control device BC100 of the embodiment shown in FIG. 5 include one or more than one methods as following, including:

1. The positive output end of the random power generator device controller RPC100 is connected with the input end of the charge control device BC100 which receives positive power from the rectifier device BR100, while the negative output end of the random power generator device controller RPC100 is connected with the negative output end of the rectifier device BR100;

2. The positive output end of the random power generator device controller RPC100 is forward series connected with a diode CR101 and further connected with the input end of the charge control device BC100 which receives positive power from the rectifier device BR100, while the negative output end of the random power generator device controller RPC100 is connected with the negative output end of the rectifier device BR100;

3. The positive output end of the random power generator device controller RPC100 is forward series connected with a diode CR101 and further connected with the input end of the charge control device BC100 which receives positive power supplied by the rectifier device BR100 through a diode CR102 in forward series connection, while the negative output end of the random power generator device controller RPC100 is connected with the negative output end of the rectifier device BR100;

4. The positive output end of the random power generator device controller RPC100 is connected to the input end of the charge control device BC100 which receives positive power supplied by the rectifier device BR100 through a diode CR102 in forward series connection, while the negative output end of the random power generator device controller RPC100 is connected to the negative output end of the rectifier device BR100.

Each component of said lamp driving circuit of power source and charge/discharge device in parallel connection as described above can be independently installed or integrally combined by relevant components.

Figure 6:
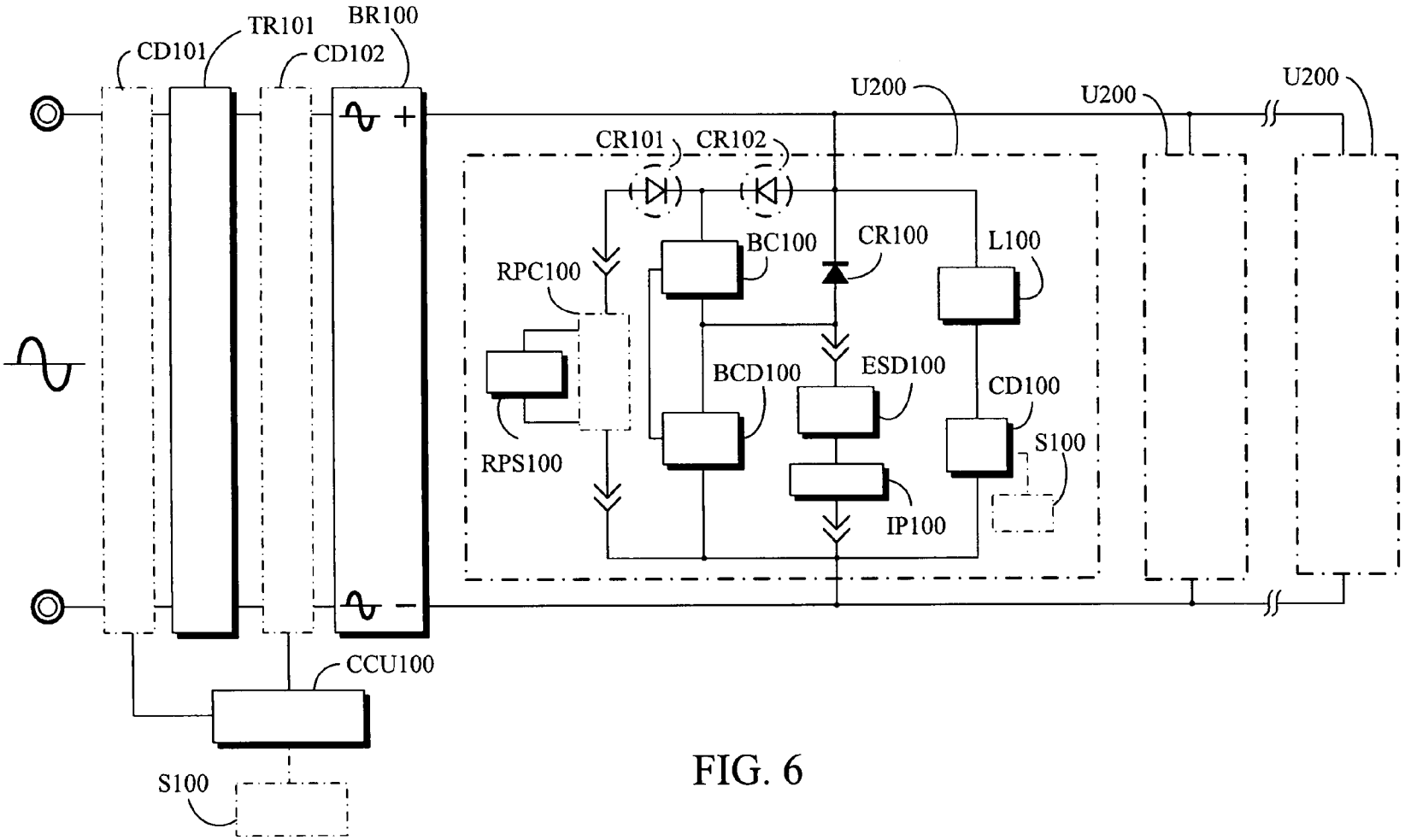
FIG. 6 is a circuit schematic view of the embodiment in FIG. 2 showing that positive and negative output ends of the random power generator device controller are parallel connected to the positive input end of the charge control device and the negative output end of the rectifier device.

FIG. 6 is a circuit schematic view of the embodiment in FIG. 2 showing that positive and negative output ends of the random power generator device controller RPC100 are parallel connected to the positive input end of the charge control device BC100 and the negative output end of the rectifier device BR100.

The methods for connecting the output end of the random power generator device controller RPC100 and the charge control device BC100 of the embodiment shown in FIG. 6 include one or more than one methods as following, including:

1. The positive output end of the random power generator device controller RPC100 is connected with the input end of the charge control device BC100 which receives positive power from the rectifier device BR100, while the negative output end of the random power generator device controller RPC100 is connected with the negative output end of the rectifier device BR100;

2. The positive output end of the random power generator device controller RPC100 is forward series connected with a diode CR101 and further connected with the input end of the charge control device BC100 which receives positive power from the rectifier device BR100, while the negative output end of the random power generator device controller RPC100 is connected with the negative output end of the rectifier device BR100;

3. The positive output end of the random power generator device controller RPC100 is forward series connected with a diode CR101 and further connected with the input end of the charge control device BC100 which receives positive power supplied by the rectifier device BR100 through a diode CR102 in forward series connection, while the negative output end of the random power generator device controller RPC100 is connected with the negative output end of the rectifier device BR100;

4. The positive output end of the random power generator device controller RPC100 is connected to the input end of the charge control device BC100 which receives positive power supplied by the rectifier device BR100 through a diode CR102 in forward series connection, while the negative output end of the random power generator device controller RPC100 is connected to the negative output end of the rectifier device BR100.

Each component of said lamp driving circuit of power source and charge/discharge device in parallel connection as described above can be independently installed or integrally combined by relevant components.

Figure 7:
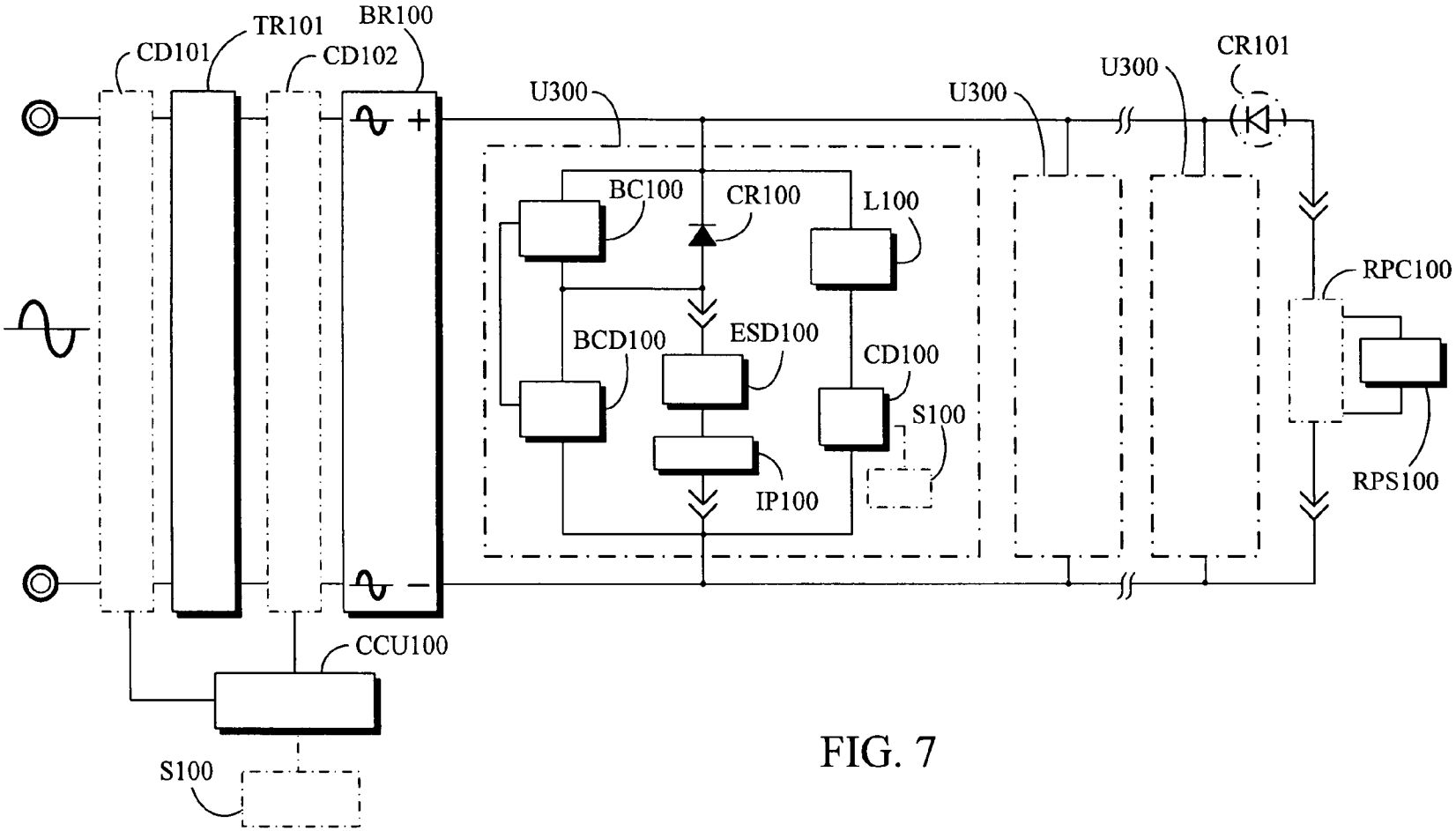
FIG. 7 is a circuit schematic view of the embodiment in FIG. 3 showing that positive and negative output ends of the random power generator device controller are parallel connected to the positive input end of the charge control device and the negative output end of the rectifier device.

FIG. 7 is a circuit schematic view of the embodiment in FIG. 3 showing that positive and negative output ends of the random power generator device controller RPC100 are parallel connected to the positive input end of charge control device BC100 and the negative output end of rectifier device BR100.

The methods for connecting the output end of the random power generator device controller RPC100 and the charge control device BC100 of the embodiment shown in FIG. 7 include one or more than one methods as following, including:

1. The positive output end of the random power generator device controller RPC100 is connected with the input end of the charge control device BC100 which receives positive power from the rectifier device BR100, while the negative output end of the random power generator device controller RPC100 is connected with the negative output end of the rectifier device BR100;

2. The positive output end of the random power generator device controller RPC100 is forward series connected with a diode CR101 and further connected with the input end of the charge control device BC100 which receives positive power from the rectifier device BR100, while the negative output end of the random power generator device controller RPC100 is connected with the negative output end of the rectifier device BR100;

Each component of said lamp driving circuit of power source and charge/discharge device in parallel connection as described above can be independently installed or integrally combined by relevant components.

Figure 8:
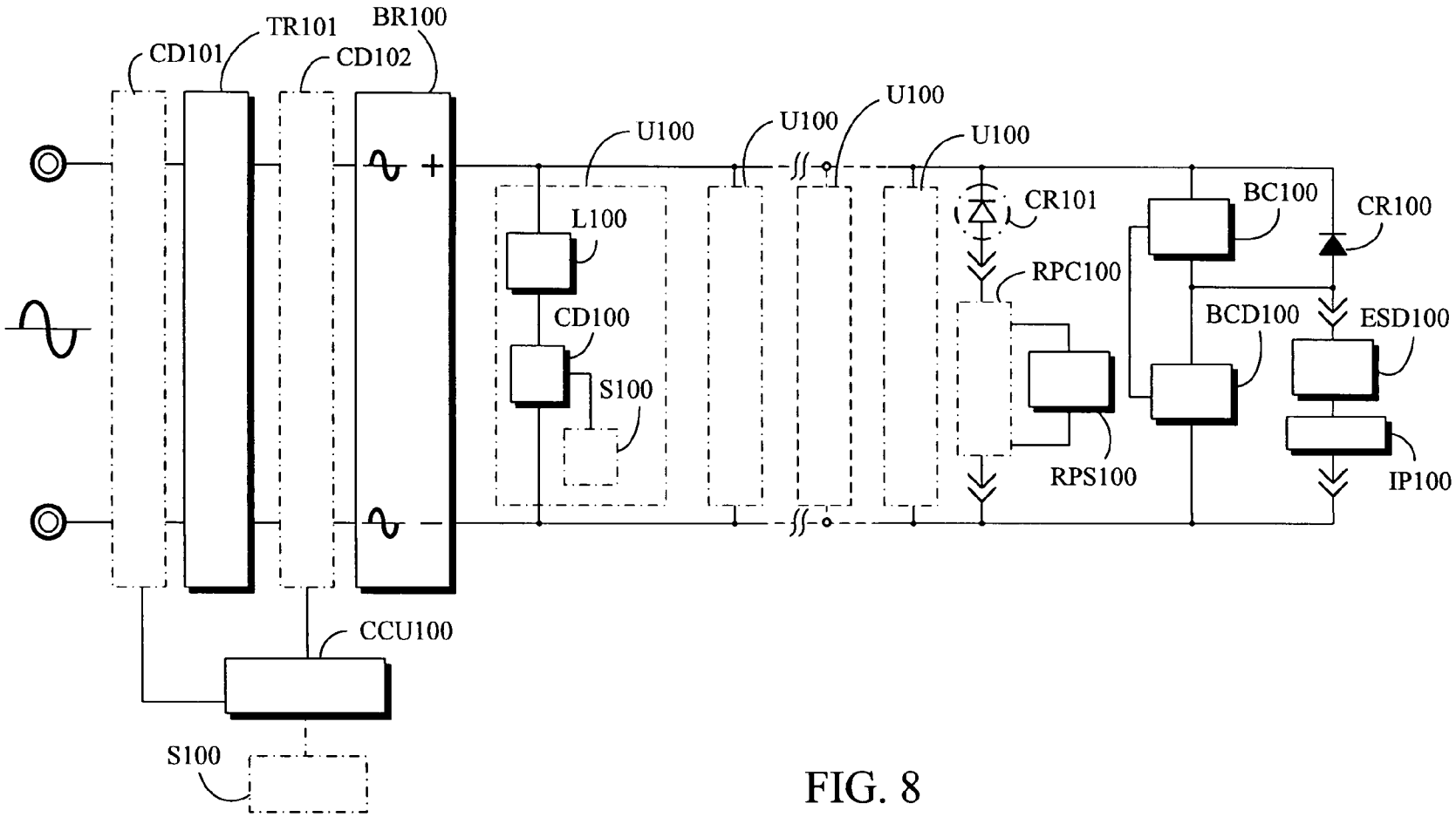
FIG. 8 is a circuit schematic view of the embodiment in FIG. 4 showing that positive and negative output ends of the random power generator device controller are parallel connected to the positive input end of the charge control device and the negative output end of the rectifier device.

FIG. 8 is a circuit schematic view of the embodiment in FIG. 4 showing that positive and negative output ends of the random power generator device controller RPC100 are parallel connected to the positive input end of the charge control device BC100 and the negative output end of the rectifier device BR100.

The methods for connecting the output end of the random power generator device controller RPC100 and the charge control device BC100 of the embodiment shown in FIG. 8 include one or more than one methods as following, including:

1. The positive output end of the random power generator device controller RPC100 is connected with the input end of the charge control device BC100 which receives positive power from the rectifier device BR100, while the negative output end of the random power generator device controller RPC100 is connected with the negative output end of the rectifier device BR100;

2. The positive output end of the random power generator device controller RPC100 is forward series connected with a diode CR101 and further connected with the input end of the charge control device BC100 which receives positive power from the rectifier device BR100, while the negative output end of the random power generator device controller RPC100 is connected with the negative output end of the rectifier device BR100;

Referring to FIGS. 1~4 for said lamp driving circuit of power source and charge/discharge device in parallel connection, wherein the random power generator device controller RPC100 of the random power generator device RPS100 can be selected not to be installed; instead, the positive output end of the random power generator device RPS100 is connected with the input end of the charge control device BC100 which receives positive power from the rectifier device BR100, while the negative output end of said random power generator device RPS100 is connected with the negative output end of the rectifier device BR100 so that the output power of the random power generator device RPS100 is modulated through the charge control device BC100 to charge said charge/discharge device ESD100; wherein methods of their parallel connections include one or more than one methods as following, including:

1. The positive output end of the random power generator device RPS100 is connected with the input end of the charge control device BC100 which receives positive power from the rectifier device BR100, while the negative output end of the random power generator device RPS100 is connected with the negative output end of the rectifier device BR100;

2. The positive output end of the random power generator device RPS100 is forward series connected with a diode CR101 and further connected with the input end of the charge control device BC100 which receives positive power from the rectifier device BR100, while the negative output end of the random power generator device RPS100 is connected with the negative output end of the rectifier device BR100;

3. The positive output end of the random power generator device RPS100 is forward series connected with a diode CR101 and further connected with the input end of the charge control device BC100 which receives positive power supplied by the rectifier device BR100 through a diode CR102 in forward series connection, while the negative output end of the random power generator device RPS100 is connected with the negative output end of the rectifier device BR100;

4. The positive output end of the random power generator device RPS100 is connected to the input end of the charge control device BC100 which receives positive power supplied by the rectifier device BR100 through a diode CR102 in forward series connection, while the negative output end of the random power generator device RPS100 is connected to the negative output end of the rectifier device BR100.

Each component of said lamp driving circuit of power source and charge/discharge device in parallel connection as described above can be independently installed or integrally combined by relevant components.

Figure 9:
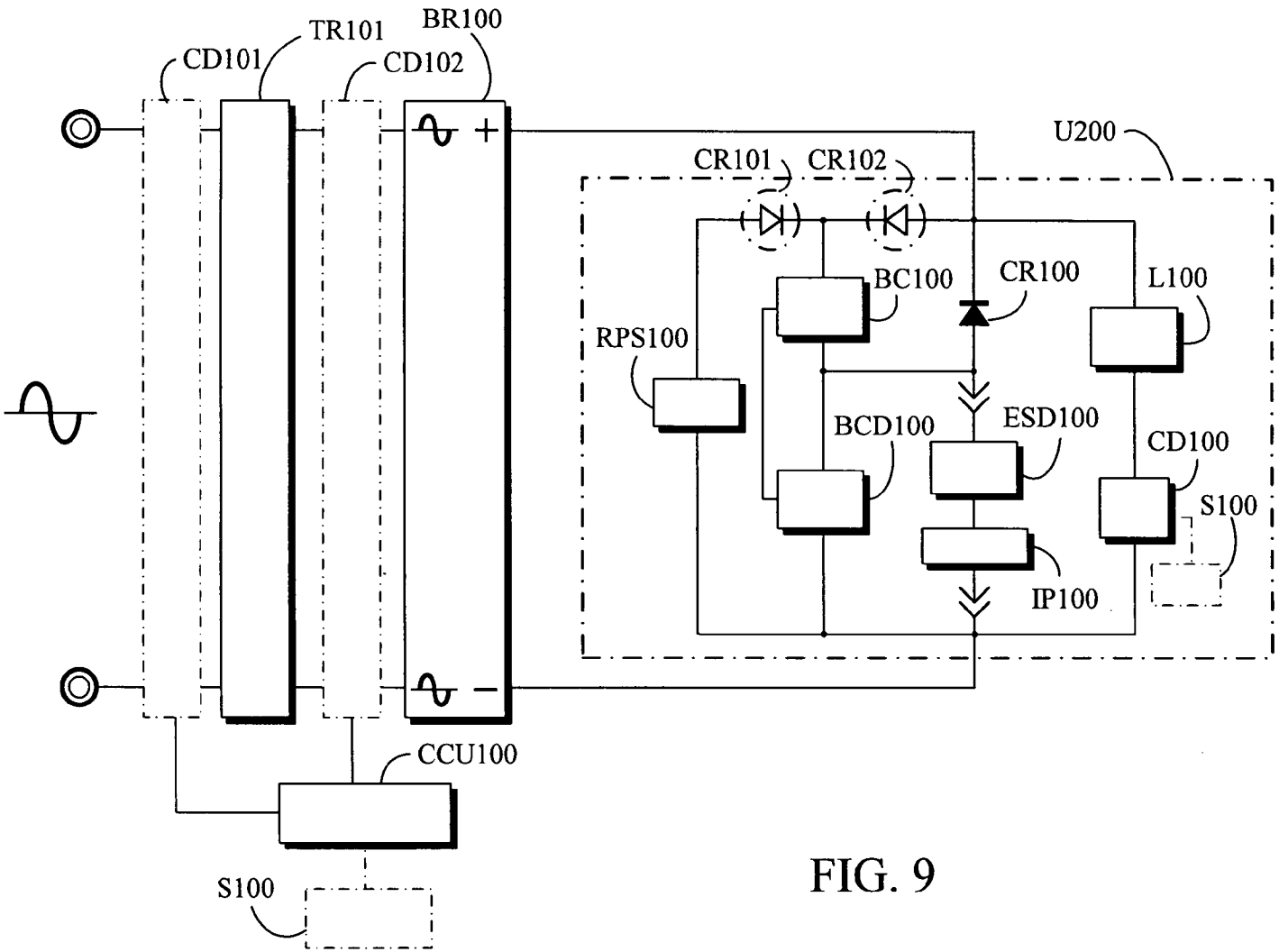
FIG. 9 is a circuit schematic view of the embodiment in FIG. 1 showing that the random power generator device controller is not installed; instead the positive and negative output ends of the random power generator device are parallel connected with the positive input end of the charge control device and the negative output end of the rectifier device.

FIG. 9 is a circuit schematic view of the embodiment in FIG. 1 showing that the random power generator device controller RPC100 is not installed; instead the positive and negative output ends of the random power generator device RPS100 are parallel connected with the positive input end of the charge control device BC100 and the negative output end of the rectifier device BR100.

The methods for connecting the output end of the random power generator device controller RPC100 and the charge control device BC100 of the embodiment shown in FIG. 9 include one or more than one methods as following, including:

1. The positive output end of the random power generator device RPS100 is connected with the input end of the charge control device BC100 which receives positive power from the rectifier device BR100, while the negative output end of the random power generator device RPS100 is connected with the negative output end of the rectifier device BR100;

2. The positive output end of the random power generator device RPS100 is forward series connected with a diode CR101 and further connected with the input end of the charge control device BC100 which receives positive power from the rectifier device BR100, while the negative output end of the random power generator device RPS100 is connected with the negative output end of the rectifier device BR10;

3. The positive output end of the random power generator device RPS100 is forward series connected with a diode CR101 and further connected with the input end of the charge control device BC100 which receives positive power supplied by the rectifier device BR100 through a diode CR102 in forward series connection, while the negative output end of the random power generator device RPS100 is connected with the negative output end of the rectifier device BR100;

4. The positive output end of the random power generator device RPS100 is connected to the input end of the charge control device BC100 which receives positive power supplied by the rectifier device BR100 through a diode CR102 in forward series connection, while the negative output end of the random power generator device RPS100 is connected to the negative output end of the rectifier device BR100.

Each component of said lamp driving circuit of power source and charge/discharge device in parallel connection as described above can be independently installed or integrally combined by relevant components.

Figure 10:
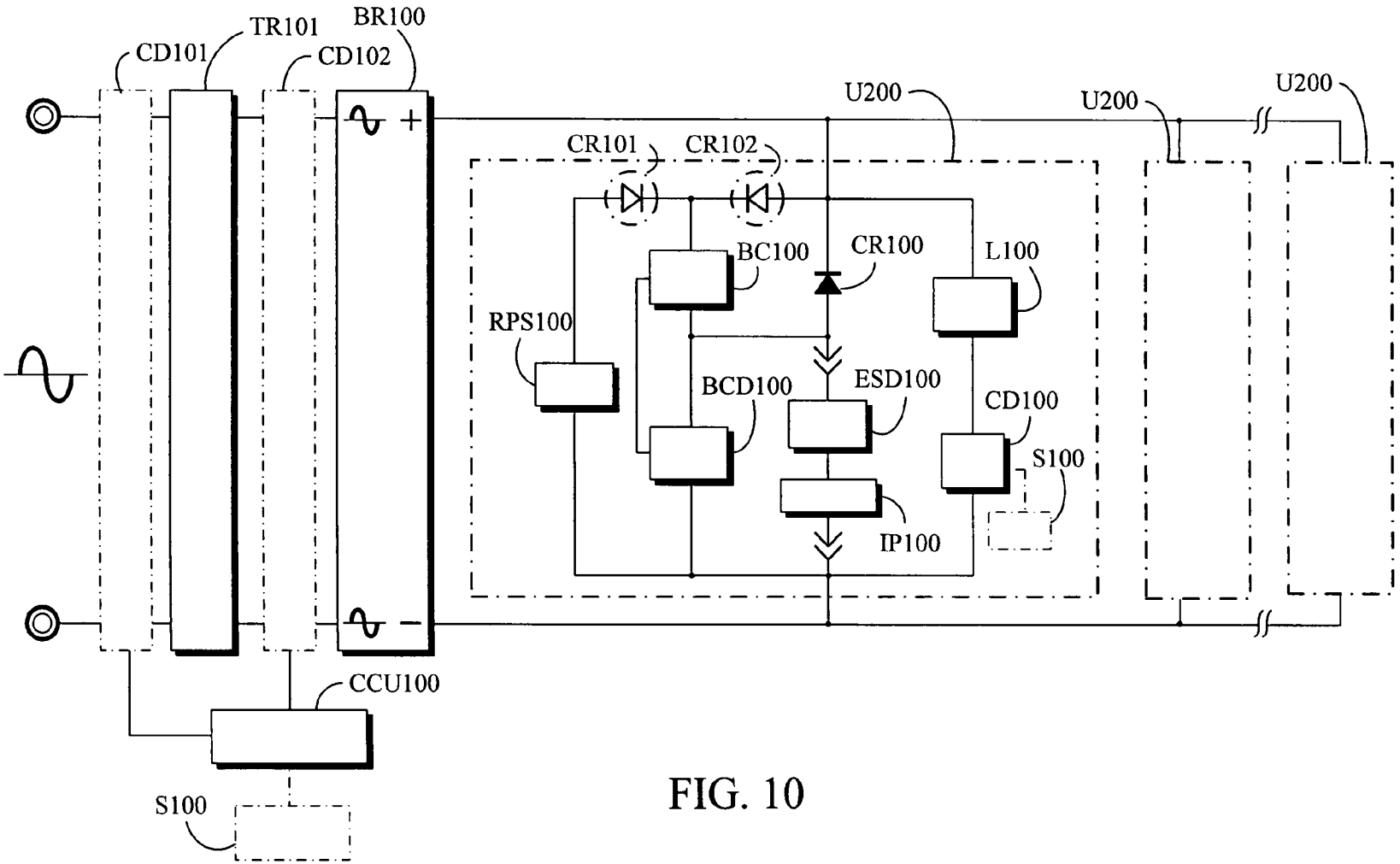
FIG. 10 is a circuit schematic view of the embodiment in FIG. 2 showing that the random power generator device controller is not installed; instead the positive and negative output ends of the random power generator device are parallel connected with the positive input end of the charge control device and the negative output end of the rectifier device.

FIG. 10 is a circuit schematic view of the embodiment in FIG. 2 showing that the random power generator device controller RPC100 is not installed; instead the positive and negative output ends of the random power generator device RPS100 are parallel connected with the positive input end of the charge control device BC100 and the negative output end of the rectifier device BR100.

The methods for connecting the output end of the random power generator device RPS100 and the charge control device BC100 of the embodiment shown in FIG. 10 include one or more than one methods as following, including:

1. The positive output end of the random power generator device RPS100 is connected with the input end of the charge control device BC100 which receives positive power from the rectifier device BR100, while the negative output end of the random power generator device RPS100 is connected with the negative output end of the rectifier device BR100;

2. The positive output end of the random power generator device RPS100 is forward series connected with a diode CR101 and further connected with the input end of the charge control device BC100 which receives positive power from the rectifier device BR100, while the negative output end of the random power generator device RPS100 is connected with the negative output end of the rectifier device BR100;

3. The positive output end of the random power generator device RPS100 is forward series connected with a diode CR101 and further connected with the input end of the charge control device BC100 which receives positive power supplied by the rectifier device BR100 through a diode CR102 in forward series connection, while the negative output end of the random power generator device RPS100 is connected with the negative output end of the rectifier device BR100;

4. The positive output end of the random power generator device RPS100 is connected to the input end of the charge control device BC100 which receives positive power supplied by the rectifier device BR100 through a diode CR102 in forward series connection, while the negative output end of the random power generator device RPS100 is connected to the negative output end of the rectifier device BR100.

Each component of said lamp driving circuit of power source and charge/discharge device in parallel connection as described above can be independently installed or integrally combined by relevant components.

Figure 11:
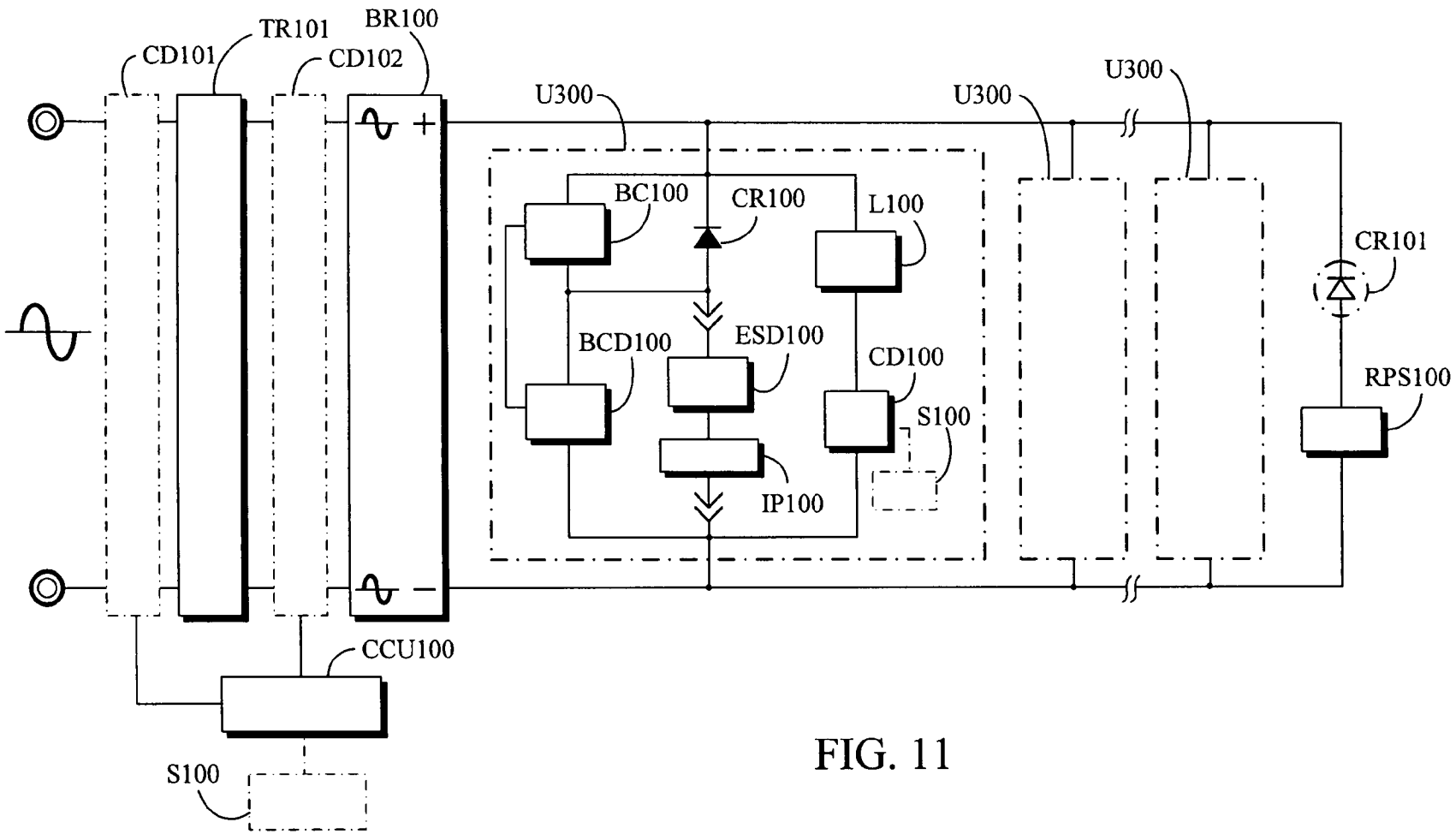
FIG. 11 is a circuit schematic view of the embodiment in FIG. 3 showing that the random power generator device controller is not installed; instead the positive and negative output ends of the random power generator device are parallel connected with the positive input end of the charge control device and the negative output end of the rectifier device.

FIG. 11 is a circuit schematic view of the embodiment in FIG. 3 showing that the random power generator device controller RPC100 is not installed; instead the positive and negative output ends of the random power generator device RPS100 are parallel connected with the positive input end of the charge control device BC100 and the negative output end of the rectifier device BR100.

The methods for connecting the output end of the random power generator device RPS100 and the charge control device BC100 of the embodiment shown in FIG. 11 include one or more than one methods as following, including:

1. The positive output end of the random power generator device RPS100 is connected with the input end of the charge control device BC100 which receives positive power from the rectifier device BR100, while the negative output end of the random power generator device RPS100 is connected with the negative output end of the rectifier device BR100;

2. The positive output end of the random power generator device RPS100 is forward series connected with a diode CR101 and further connected with the input end of the charge control device BC100 which receives positive power from the rectifier device BR100, while the negative output end of the random power generator device RPS100 is connected with the negative output end of the rectifier device BR100;

Each component of said lamp driving circuit of power source and charge/discharge device in parallel connection as described above can be independently installed or integrally combined by relevant components.

Figure 12:
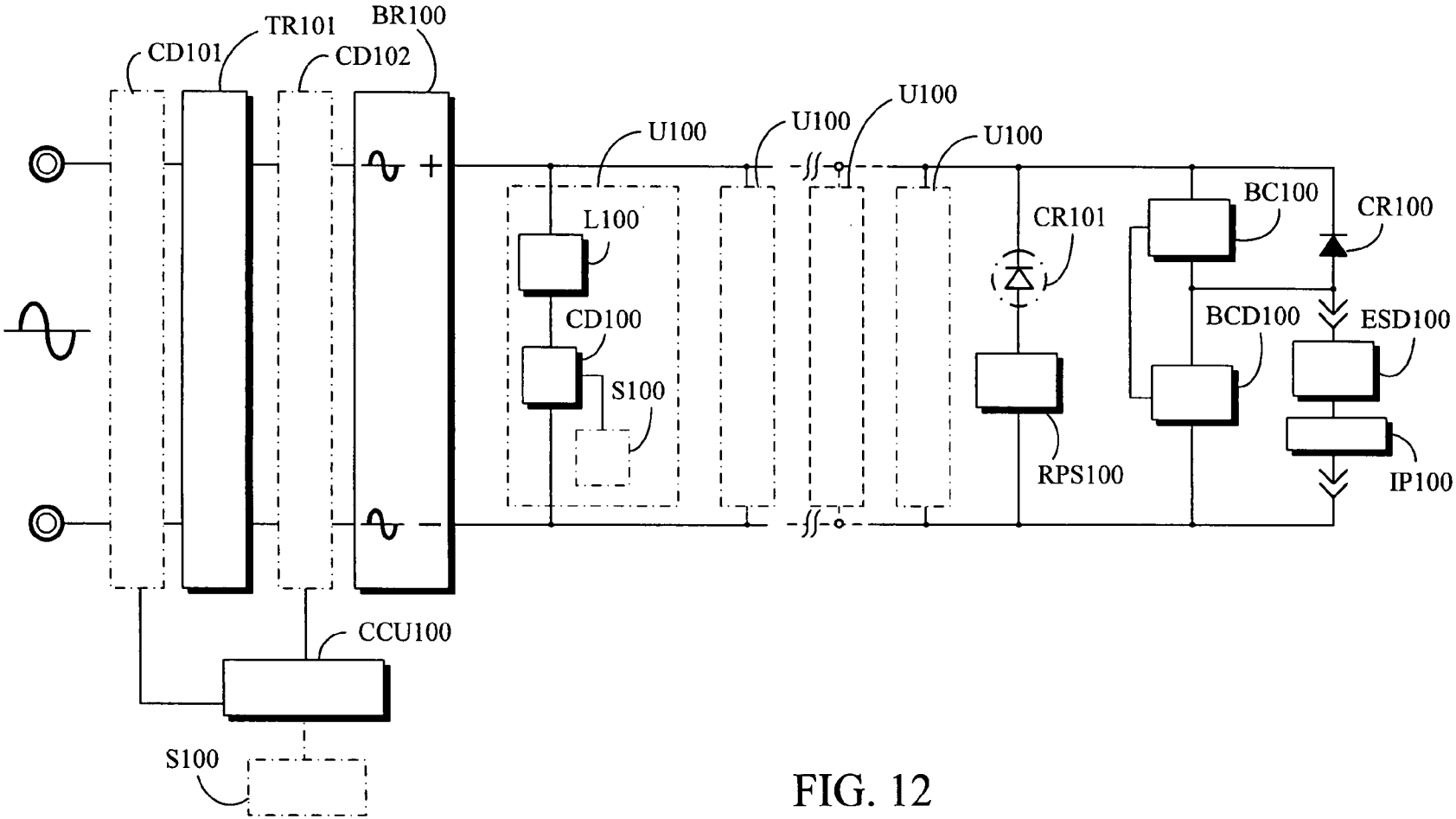
FIG. 12 is a circuit schematic view of the embodiment in FIG. 4 showing that the random power generator device controller is not installed; instead the positive and negative output ends of the random power generator device are parallel connected with the positive input end of the charge control device and the negative output end of the rectifier device.

FIG. 12 is a circuit schematic view of the embodiment in FIG. 4 showing that the random power generator device controller RPC100 is not installed; instead the positive and negative output ends of the random power generator device RPS100 are parallel connected with the positive input end of the charge control device BC100 and the negative output end of the rectifier device BR100.

The methods for connecting the output end of the random power generator device RPS100 and the charge control device BC100 of the embodiment shown in FIG. 12 include one or more than one methods as following, including:

1. The positive output end of the random power generator device RPS100 is connected with the input end of the charge control device BC100 which receives positive power from the rectifier device BR100, while the negative output end of the random power generator device RPS100 is connected with the negative output end of the rectifier device BR100;

2. The positive output end of the random power generator device RPS100 is forward series connected with a diode CR101 and further connected with the input end of the charge control device BC100 which receives positive power from the rectifier device BR100, while the negative output end of the random power generator device RPS100 is connected with the negative output end of the rectifier device BR100;

Each component of said lamp driving circuit of power source and charge/discharge device in parallel connection as described above can be independently installed or integrally combined by relevant components.

As summarized from above descriptions, said lamp driving circuit of power source and charge/discharge device in parallel connection is by installing a charge/discharge device ESD100, the relevant charge control devices and an isolated diode for use in the following:

(1) The charge preparation status in which the AC power is converted to a DC power; and (2) The parallel output status in which said two powers are parallel connected to commonly drive the lamps.

Due to daytime on and nighttime off period of said lamps, said lamp driving circuit of power source and charge/discharge device in parallel connection can be embodied by that during daytime, the AC to DC power is charged to said charge/discharge device ESD 100, and during nighttime, the lamps L100 are commonly driven by the parallel output of the AC to DC power and the discharged power of said charge/discharge device ESD100, so that required power capacity of the device for voltage change and current rectification can be reduced and the required charging capacity for the charge/discharge device ESD100 is also reduced to lower the cost and save resources. In addition, said charge/discharge device ESD100 can be installed at terminal ends of extension cords, so that the disadvantages of too much voltage drop at terminal ends of extension cords can be avoided when multiple lamps are parallel connected by long extension cords.

The invention claimed is:

1. A charging/lamp driving circuit arranged to receive a charge/discharge device (ESD100) when the charge/discharge device is installed in the charging/lamp driving circuit by a user, comprising:

at least one lamp (L100);

a transformer device (TR101);

a rectifier device (BR100) for rectifying an output of a secondary side of the transformer device (TR100) to supply DC power to the lamp (L100) and to the charge/discharge device (ESD100) when the charge/discharge device has been installed by the user;

an output diode (CR100); and a charge control device (BC100) parallel connected to the output diode (CR100), wherein when said charge/discharge device is installed in said charging/lamp driving circuit, a negative output end of said charge/discharge device is connected to a negative DC power output end of the rectifier device (BR100) and a positive output end of said charge/discharge device is connected through the output diode (CR100) to both the positive DC power output end of the rectifier device and to the lamp (L100), and wherein, depending on whether the charge/discharge device (ESD100) has been installed by the user in the charging/lamp driving circuit and on a charging state of the charge/discharge device (ESD100), said charging/lamp driving circuit is arranged to drive the lamp by:

(a) simultaneously and in parallel supplying power to the lamp from the rectifier device (BR100) and, through the output diode (CR100), from the charge/discharge device (ESD100);

(b) supplying power to the lamp exclusively from the charge/discharge device (ESD100) through the output diode (CR100), and (c) supplying power to the lamp exclusively from the rectifier device (BR100) while the rectifier device (BR100) charges the charge/discharge device through the charge control device (BC 100), or the charge/discharge device has not been installed in the charging/lamp driving circuit by the user, and further comprising a lamp control device (CD 100) to control or modulate a supply of power to the at least one lamp (L100) in response to control signals from a central control unit (CCU100) or light detector device (S100), and wherein the simultaneous and parallel supply of power to the at least one lamp (L100) from the charge/discharge device (ESD100) and the rectifier device (BR100) enables selection of a lower capacity charge/discharge device and lower capacity components of the rectifier device (BR100) relative to larger capacities that would be required if there were no parallel supply of power and power were supplied exclusively by one of the charge/discharge (ESD100) or the rectifier device (BR100).

2. The charging/lamp driving circuit as claimed in claim 1, further comprising:

a power side control device (CD101) connected between an AC power source and an input side of the transformer device (TR101) and operatively controlled by a central control unit (CCU100) or by a light detector device (S100) for controlling a supply of AC power from said AC power source to said transformer device.

3. The charging/lamp driving circuit as claimed in claim 2, wherein said AC power source is one of a utility AC power supply, AC power generator, and DC-AC converter.

4. The charging/lamp driving circuit as claimed in claim 1, further comprising:

an output side control device (CD102) connected between the output side of the transformer device (TR101) and an input side of the rectifier device (BR100) and operatively controlled by a central control unit (CCU100) or by a light detector device (S100) for controlling a supply of AC power from said transformer device to said rectifier device.

5. The charging/lamp driving circuit as claimed in claim 1, wherein said charge/discharge device (ESD100) is one of a secondary battery and a super-capacitor.

6. The charging/lamp driving circuit as claimed in claim 5, wherein said secondary battery is one or more of: a nickel series battery selected from a lead-acid, nickel-cadmium, nickel-hydrogen, and nickel-zinc battery, and a lithium series battery.

7. The charging/lamp driving circuit as claimed in claim 1, wherein said charge/discharge device is fixedly installed in the charging/lamp driving circuit or installed in said charging/lamp driving circuit by a plug, a socket set, or a connector.

8. The charging/lamp driving circuit as claimed in claim 1, further comprising a charge control device (BC100) connected between an output of the rectifier device (BR100) and the charge/discharge device (ESD100) for controlling a charging voltage and current supplied to the charging/discharge device, said charge control device (BC100) being connected in parallel with said output diode (CR100).

9. The charging/lamp driving circuit as claimed in claim 1, further comprising a charging status measuring device (BCD100) for measuring end voltage, internal resistance, specific gravity, charging capacity or discharging capacity of the charge/discharge device (ESD100) and for supplying measurement signals to a charge control device (BC100) or central control unit (CCU100).

10. The charging/lamp driving circuit as claimed in claim 1, further comprising an overcurrent protective device (IP100) connecting in series between the input and output ends of the charge/discharge device (ESD100), said over current protective device including at least one of a resistive or inductive impedance component, a combination of resistive and inductive impedance components, a semi-conductor component having a voltage drop, a safety fuse, and an overload breaker.

11. The charging/lamp driving circuit as claimed in claim 1, further comprising a central control unit (CCUl00) constituted by electromechanical, solid state electronic components, or a microprocessor and software for setting a power on/off timing or mode for the at least one lamp (L100).

12. The charging/lamp driving circuit as claimed in claim 11, wherein said central control unit (CCU100) operates the at least one lamp device (L100) based at least in part on an input from a light detector device (S100) that detects ambient light.

13. The charging/lamp driving circuit as claimed in claim 1, further comprising a random power generator device (RPS100) connected in parallel across DC output ends of the rectifier device (BR100) and a random power generator device controller (RPC100) installed across DC output ends of the random power generator device (RPS100) for controlling a voltage and current output by the random power generator device (RPS100).

14. The charging/lamp driving circuit as claimed in claim 13, wherein said random power generator device (RPS100) is one of a solar power generator device, a wind power generator device, and a hydraulic power generator device.

15. The charging/lamp driving circuit as claimed in claim 1, wherein components of the charging/lamp driving circuit are integrally combined in one or more of the following combinations:

(a) the transformer device (TR101) and rectifier device (BR100) are integrally combined with power source and output side control devices (CD101,CD102) and a central control unit (CCU100);

(b) a random power generator device controller (RPC100) is integrally combined with a random power generator device (RPS100);

(c) the charge/discharge device (ESD100) and output diode (CR100) are integrally combined with an over current protective device (IP100), charging status measuring device (BCD100), and charge control device (BC100);

(d) the lamp (L100) is integrally combined with a lamp control device (CD100) and ambient light detector device (S100) to form a lamp unit (U100);

(e) the charge/discharge device (ESD100) and output diode (CR100) is integrally combined with said random power generator device controller (RPC100), random power generator device (RPS100), over current protective device (IP100), charge control device (BC100), charging status measuring device (BCD100), and at least one lamp to form a lamp unit (U200);

(f) the charge/discharge device (ESD100) and output diode (CR100) is integrally combined with said over current protective device (IP100), charge control device (BC 100), charging status measuring device (BCD100), lamp control device (CD100), light detector (S100), and at least one lamp (L100) to form the lamp unit (U200); and (g) the charge/discharge device (ESD100) and output diode (CR100) is integrally combined with said over current protective device (IP100), charge control device (BC 100), charging status measuring device (BCD 100), lamp control device (CD 100), light detector (S 100), random power generator device controller (RPC100), random power generator device (RPS100), and at least one lamp (L100) to form a lamp assembly (U300).

16. The charging/lamp driving circuit as claimed in claim 1, wherein said at least one lamp (L100) includes at least two lamps respectively provided in at least two lamp assemblies (U300), each provided with at least one said charge/discharge device (ESD100) and output diode (CR100), said lamp assemblies being connected in parallel across the DC output ends of the rectifier device (BR100) or extension cords connected to the DC output ends of the rectifier device (BR100).

17. The charging/lamp driving circuit as claimed in claim 16, wherein said lamp assemblies (U300) each further includes an over current protective device (IP100), a charge control device (BC100), a charging status measuring device (BCD100), a lamp control device (CD 100), an ambient light detector (S100), a random power generator device controller (RPC100), and a random power generator device (RPS100), and wherein the ambient light detector (S100) controls a supply of power to or output by the transformer device, is connected to the lamp control device (CD100) to control on/off operation of the at least one lamp (L100), or controls both the supply of power to or output by the transformer device and on/off operation of the at least one lamp (100).

18. The charging/lamp driving circuit as claimed in claim 1, wherein a random power generator device (RPS100) and random power generator device controller (RPC100) are parallel connected to extension cords to power a respective said at least one lamp (L100) provided in a plurality of lamp units (U200), each lamp unit (U200) including an ambient light sensor (S100) for controlling a supply of power from the output ends of the rectifier device (BR100) or on/off operation of the respective said at least one lamp unit (L100).

19. The charging/lamp driving circuit as claimed in claim 1, wherein a respective said charge/discharge device (ESD100) is included in each of a plurality of parallel-connected lamp units (U100), each including a respective said at least one lamp (L100) series connected with a lamp control device (CD100) and ambient light detector (S100).

20. The charging/lamp driving circuit as claimed in claim 1, further comprising a random power generator device (RPS100) controlled by a random power generator device controller (RPC 100), said random power generator device controller being connected in one of the following ways:

(a) a positive output end of the random power generator device controller (RPC100) is connected to the input end of a charge control device (BC100) which receives positive power from the rectifier device (BR100), and a negative output end of the random power generator device controller is connected to the negative output end of the rectifier device (BR100);

(b) the positive output end of the random power generator device controller (RPC 100) is forward series connected with the output diode (CR101) and further connected with the input end of the charge control device (BC100) which receives positive power from the rectifier device (BR100), and the negative output end of the random power generator device controller (RPC100) is connected with the negative output end of the rectifier device (BR100);

(c) the positive output end of the random power generator device controller (RPC 100) is forward series connected with the output diode (CR101) and further connected with the input end of the charge control device (BC100) through a second diode (CR102) in forward series connection, and the negative output end of the random power generator device controller (RPC100) is connected with the negative output end of the rectifier device (BR100);

(d) the positive output end of the random power generator device controller (RPC100) is connected to the input end of the charge control device (BC100) which receives positive power supplied by the rectifier device (BR100) through a diode (CR102) in forward series connection, and the negative output end of the random power generator device controller (RPC 100) is connected to the negative output end of the rectifier device (BR100).

21. The charging/lamp driving circuit as claimed in claim 20, wherein the positive output end of the random power generator device controller (RPC100) is connected with the input end of the charge control device BC100 which receives positive power from the rectifier device (BR100) so that output power of the random power generator device (RPS100) is modulated through the random power generator device controller (RPC100) and the charge control device (BC100) to charge the charge/discharge device (ESD100).

22. The charging/lamp driving circuit as claimed in claim 20, wherein the positive and negative output ends of the random power generator device controller (RPC100) are parallel connected to the positive input end of the charge control device (BC100) and the negative output end of the rectifier device (BR100).

23. The charging/lamp driving circuit as claimed in claim 1, further comprising a random power generator device (RPS100), said random power generator device controller being connected in one of the following ways:

(a) a positive output end of the random power generator device (RPS100) is connected to the input end of a charge control device (BC100) which receives positive power from the rectifier device (BR100), and a negative output end of the random power generator device controller is connected to the negative output end of the rectifier device (BR100);

(b) the positive output end of the random power generator device (RPS100) is forward series connected with the output diode (CR101) and further connected with the input end of the charge control device (BC100) which receives positive power from the rectifier device (BR100), and the negative output end of the random power generator device (RPS100) is connected with the negative output end of the rectifier device (BR100);

(c) the positive output end of the random power generator device (RPS100) is forward series connected with the output diode (CR101) and further connected with the input end of the charge control device (BC100) through a second diode (CR102) in forward series connection, and the negative output end of the random power generator device (RPS100) is connected with the negative output end of the rectifier device (BR100);

(d) the positive output end of the random power generator device (RPS100) is connected to the input end of the charge control device (BC100) which receives positive power supplied by the rectifier device (BR100) through a diode (CR102) in forward series connection, and the negative output end of the random power generator device (RPS100) is connected to the negative output end of the rectifier device (BR100).

24. The charging/lamp driving circuit as claimed in claim 23, wherein the positive output end of the random power generator device (RPS100) is connected with the input end of the charge control device BC 100 which receives positive power from the rectifier device (BR100) so that output power of the random power generator device (RPS100) is modulated through the random power generator device controller (RPC100) and the charge control device (BC100) to charge the charge/discharge device (ESD100).

25. The charging/lamp driving circuit as claimed in claim 23, wherein the positive and negative output ends of the random power generator device (RPS100) are parallel connected to the positive input end of the charge control device (BC100) and the negative output end of the rectifier device (BR100).

* * * * *